US006757915B2

(12) United States Patent
Sidlo

(10) Patent No.: US 6,757,915 B2
(45) Date of Patent: Jul. 6, 2004

(54) HAND-PROTECTION ACCESSORY

(76) Inventor: Alan Dion Sidlo, 1252 W. Elmdale Ave., Suite 200, Chicago, IL (US) 60660

( * ) Notice: Subject to any disclaimer, the term of this patent is extended or adjusted under 35 U.S.C. 154(b) by 13 days.

(21) Appl. No.: 10/195,512

(22) Filed: Jul. 16, 2002

(65) Prior Publication Data

US 2004/0010834 A1 Jan. 22, 2004

(51) Int. Cl.[7] ..... A41D 13/08
(52) U.S. Cl. ..... 2/16; 2/20
(58) Field of Search ..... 2/16, 20, 163, 2/161.1–161.4, 161.6, 23; 128/879; 602/21; 482/44, 48, 49

(56) References Cited

U.S. PATENT DOCUMENTS 3,496,573 A * 2/1970 Kuchar et al. ..... 2/161.6
3,896,498 A * 7/1975 Pang ..... 2/20
5,079,776 A * 1/1992 Crawford ..... 2/20
5,081,715 A * 1/1992 Mascia ..... 2/20
5,313,667 A * 5/1994 Levine ..... 2/16
5,479,660 A * 1/1996 Najac ..... 2/20
5,829,057 A * 11/1998 Gunn ..... 2/69

* cited by examiner

*Primary Examiner*—Katherine Moran
(74) *Attorney, Agent, or Firm*—Leydig, Voit & Mayer, Ltd.

(57) ABSTRACT

A hand-protection sporting accessory includes a flexible hand attachment for connection about a wearer's hand, and a slide pad extending from the hand. The flexible hand attachment includes a thumb loop through which the wearer's thumb can extend so as to maintain the slide pad adjacent to the palm of the hand unless deliberately released from the thumb. The accessory is particularly useful in competitive skateboarding where the slide pad can be positioned out of the way for quick race starts where the participant needs good grip with the starting gate. A quick "flick" of the hand can be made after the race start, whereby the loop lassoes the thumb to thereby place the slide pad across the palm.

5 Claims, 3 Drawing Sheets

HAND-PROTECTION ACCESSORY

BACKGROUND OF THE INVENTION

The present invention relates to a hand-protection accessory. More particularly, although not exclusively, the invention relates to an accessory for a sports glove, a sports glove incorporating an accessory, or a standalone accessory, for use in extreme sporting activities such as competitive skateboarding, to protect a participant's hands.

Competition skateboarding and rollerblading are regarded by many as extreme sporting activities, having associated dangers. Participants wear knee pads, elbow pads, shoulder pads, helmets and other protective gear. The competitors also wear hand-protective gloves to protect their hands in the event of an accident. Hand injuries can be particularly bad in a fall where the participant's palm makes sliding contact with the ground surface.

Protective gloves however, can present a burden to the participant, when handshaking, holding a drink bottle, signing an autograph, reaching into a pocket, and particularly at the commencement of a race. Moreover, to attain a good start, participants grasp the starting gate or post and pull themselves forward. Gloves having good protective and sliding capabilities in the event of an accident display exactly those properties which are undesirable in attaining good grip on the starting gate or post at race commencement.

OBJECT OF THE INVENTION

It is an object of the present invention to overcome or substantially ameliorate the above disadvantage and/or more generally to provide improved hand-protection accessory.

DISCLOSURE OF THE INVENTION

There is disclosed herein a hand-protection accessory comprising:

- a flexible hand attachment for connection about a wearer's hand,
- a pad extending from the hand attachment and including a thumb loop through which the wearer's thumb can extend so as to maintain the pad adjacent the palm of said hand unless deliberately released from the thumb.

Preferably the hand attachment includes a pair of strap segments extending about the hand.

Preferably each strap segment extends from a respective attachment area, which attachment area is attached to one another in the back of said hand.

Preferably a pad strap segment extends between the pad and the hand attachment.

Preferably the pad strap segment extends from one of the attachment areas in between said strap segments.

Preferably a pad foundation portion extends between the thumb loop and the pad strap.

Preferably the pad is a replaceable piece attached to the pad foundation portion.

Preferably the pad is a slide pad having a low dynamic coefficient of friction.

Alternatively, the pad can be a grip pad having a high static coefficient of friction.

Such an accessory might be worn upon a bare hand or outside of a glove.

As an alternative, the flexible hand attachment might be formed integrally with a glove.

Although an accessory as disclosed herein would have a primary application in the sporting activities as discussed earlier, there is also application in the workshop for example where it would be very useful as a tool holder, or in the kitchen or other places. Often, in the workshop, extra grip is required on say the handle of a screwdriver, a standing block or scrubbing brush/burnishers etc. To this end, instead of having a "slide pad" having a low dynamic coefficient of friction, this feature could be replaced with a "grip pad" having a high static coefficient of friction for achieving good grip.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
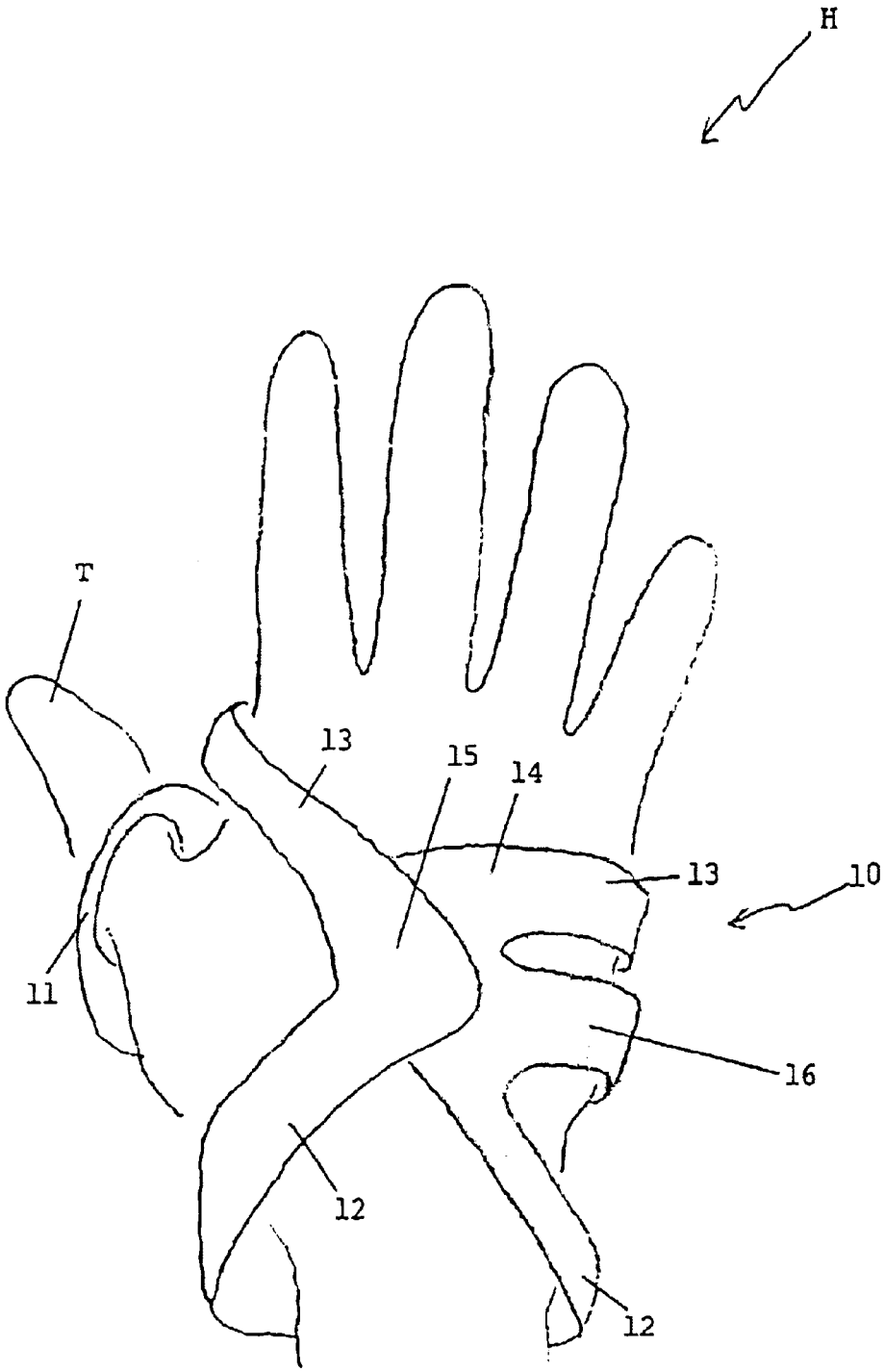
FIG. 1 is a schematic illustration of the back of a wearer's hand to which there is attached a hand-protection accessory.
Figure 2:
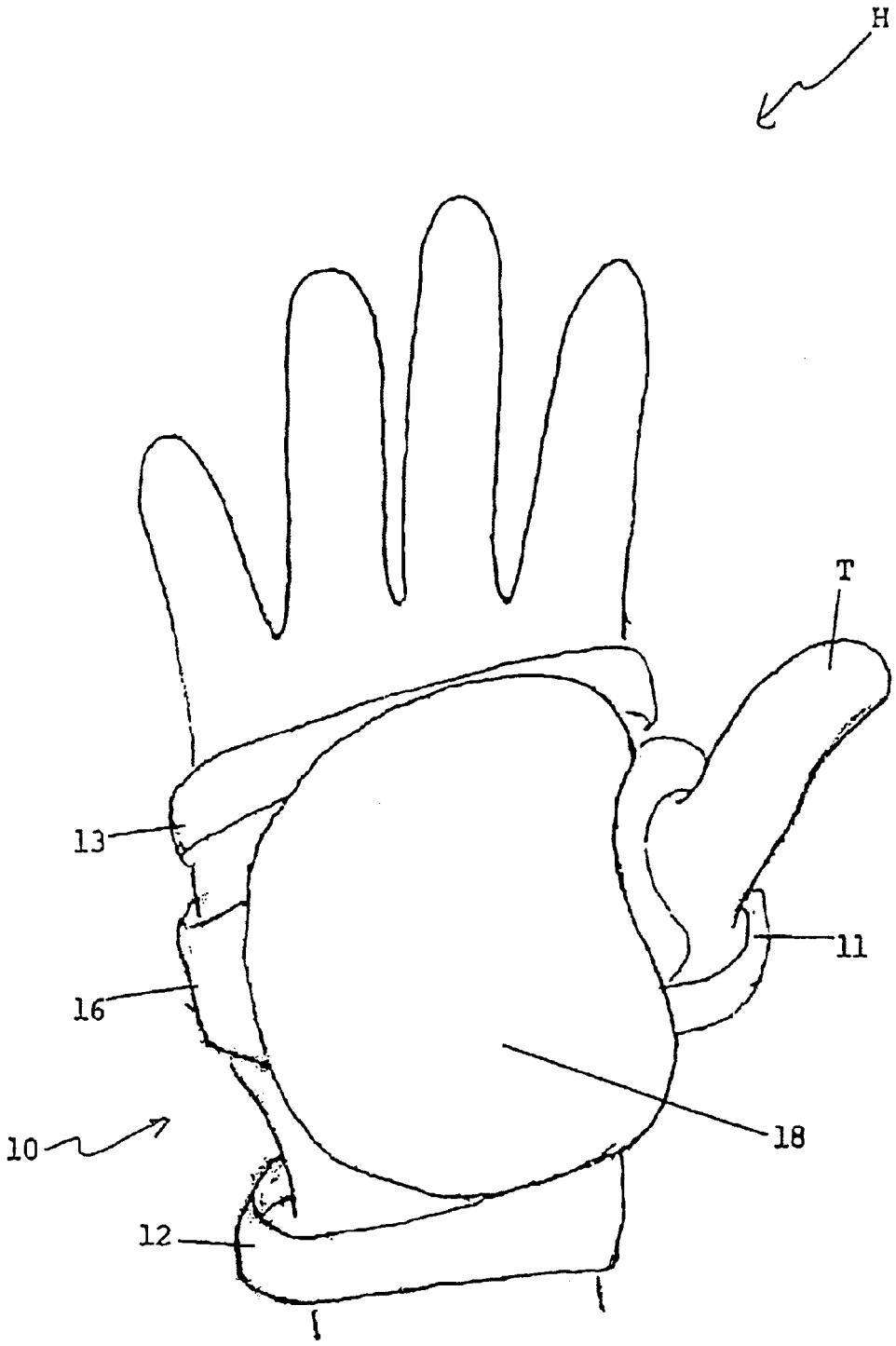
FIG. 2 is a schematic illustration of the palm-side of the hand and accessory of FIG. 1.

In the accompanying drawings there is schematically depicted a hand H having a protection accessory 10 attached thereto. Accessory 10 would typically be fabricated from polyethylene or other durable, flexible material such as leather. The material might be stretchable or non-stretchable. Accessory 10 includes a wrist strap 12 and a hand strap 13 both extending between respective connection areas 14 and 15. At these areas, there might be provided hook and loop type fastener pads for interengagement. Alternatively, buttons, laces, press-studs, clips, a buckle or other detachable means can be provided.

In between straps 12 and 13, there is provided a pad strap 16 extending from the connection area 14 to a pad foundation portion 17. Connected to the foundation portion 17 is a slide pad 18. The slide pad 18 might be stitched, glued or detachably connected to the foundation portion 17. Hook and loop fasteners might be an appropriate choice. The slide pad 18 might also be fabricated from polyethylene. A higher density polyethylene or hard-wearing, low slide resistance material can be used. The slide pad 18 might be semi-flexible or rigid. At the distal end of the pad foundation portion 17, there is provided a thumb loop 11.

Figure 3:
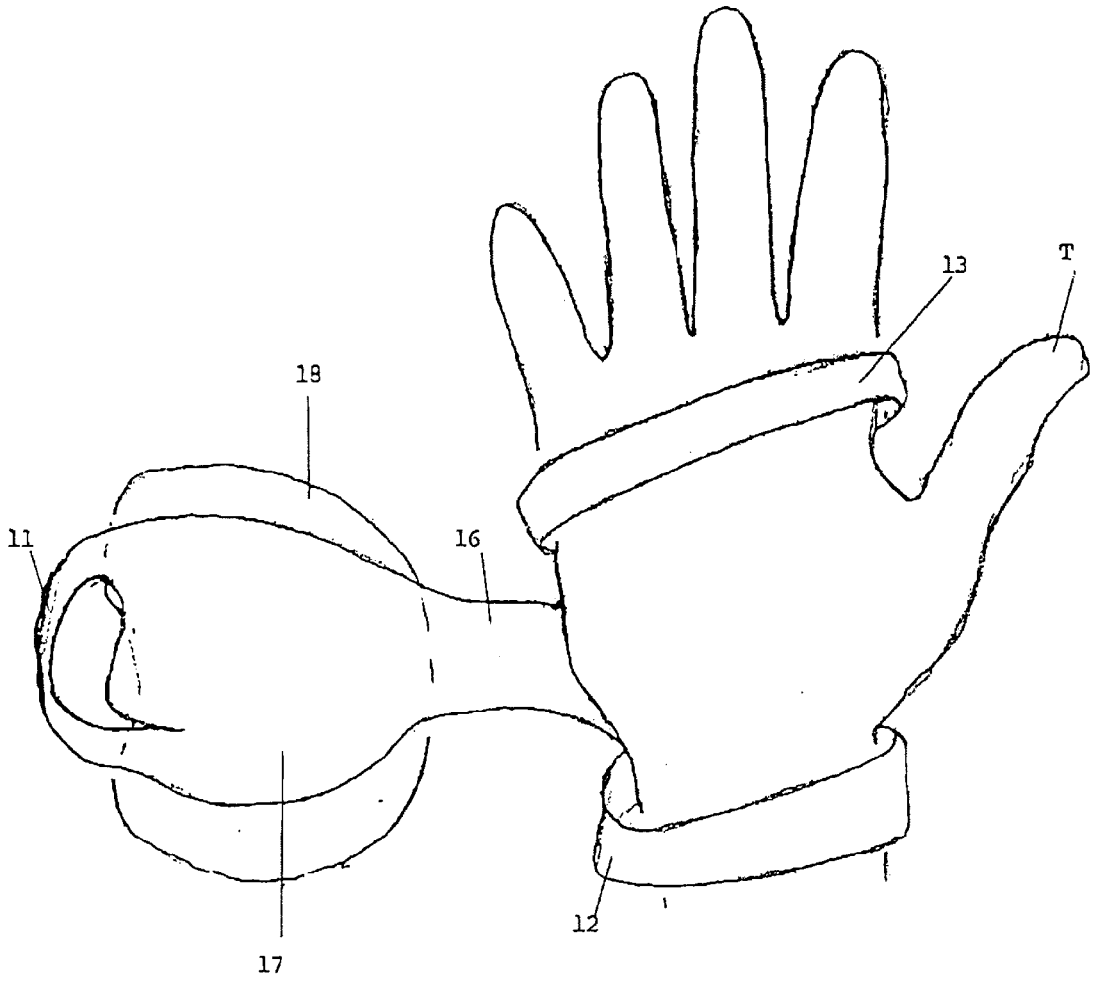
FIG. 3 is a schematic illustration of the palm-side of the wearer's hand, showing the accessory having its thumb loop and slide pad out-folded.

In use, the accessory is attached to the wearer's hand H by mutually attaching the attachment areas 14 and 15 such that the accessory takes on the configuration depicted in FIG. 3.

The thumb T can then be passed through the loop 11 by "flicking" the hand so that the foundation portion 17, slide pad 18 and loop 11 across the palm and the loop 11 lassoes the thumb. Instead of "flicking" the hand, the loop 11 can be grasped by the other hand and stretched over the thumb.

For the start of a race, the loop 11 can be detached from the thumb to enable direct gripping between the palm and the starting gate. Immediately after the start of the race, a practised "flick" of the wrist can be done to lasso the thumb with the loop 11.

The slide pad 18, in a palms-down fall, will protect the wearer's palms from grazing injury.

It should be appreciated that modifications and alterations obvious to those skilled in the art are not to be considered as beyond the scope of the present invention.

What is claimed is:

1. A hand-protection accessory comprising:

a flexible hand attachment for connection about a wearer's hand and including a pair of strap segments configured to extend about the hand, each strap segment extending across the wearer's palm from an attachment area at the back of the wearer's hand, a pad extending from the hand attachment and including a thumb loop through which the wearer's thumb extends to maintain the pad adjacent the palm of the hand unless deliberately released from the thumb, and a pad strap segment extending between the pad and the hand attachment, wherein the pad strap segment extends from the attachment area in between said strap segments.

2. The accessory of claim 1, wherein a pad foundation extends between the thumb loop and the pad strap.

3. The accessory of claim 2, wherein the pad is a replaceable piece attached to the pad foundation portion.

4. The accessory of claim 1, wherein the pad is a slide pad having a low dynamic coefficient of friction.

5. The accessory of claim 1, wherein the pad is a grip pad having a high static coefficient of friction.

* * * * *